United States Patent [19]

Waddell et al.

[11] Patent Number: 4,836,113

[45] Date of Patent: Jun. 6, 1989

[54] DETACHABLE TRAYS FOR WATER BEDS

[76] Inventors: Troy Waddell; Jerry Walker, both of P.O. Box 1164, Hereford, Tex. 79045

[21] Appl. No.: 160,312

[22] Filed: Feb. 25, 1988

[51] Int. Cl.[4] ..... A47B 23/00

[52] U.S. Cl. ..... 108/49; 5/507

[58] Field of Search..... 108/49, 97, 91, 90; 5/507

[56] References Cited

U.S. PATENT DOCUMENTS

| | | | |
|---|---|---|---|
| 1,759,749 | 5/1930 | Knight | 108/91 X |
| 2,533,893 | 12/1950 | Nussbaum | 108/49 X |
| 2,703,265 | 3/1955 | Wolfe . | |
| 3,033,627 | 5/1962 | Brown et al. | 5/507 X |
| 3,289,217 | 12/1966 | Glover | 5/507 X |
| 3,307,214 | 3/1967 | Belvedere . | |
| 3,340,826 | 9/1967 | Jenssen, Jr. . | |
| 3,629,881 | 12/1971 | Hinshaw . | |
| 3,706,105 | 12/1972 | Nicholas et al. | 5/507 X |
| 3,893,569 | 7/1975 | Hoch | 108/44 X |
| 3,955,788 | 5/1976 | Delage . | |
| 4,180,878 | 1/1980 | Howell . | |
| 4,203,175 | 5/1980 | Heine . | |
| 4,357,881 | 11/1982 | De Long . | |
| 4,431,154 | 2/1984 | Hamm . | |
| 4,504,992 | 3/1985 | Herron et al. . | |
| 4,512,607 | 4/1985 | Rapp | 108/49 X |

*Primary Examiner*—Kenneth J. Dorner
*Assistant Examiner*—José V. Chen
*Attorney, Agent, or Firm*—Dowell & Dowell

[57] ABSTRACT

Detachable trays for water beds having wooden side rails and headboards wherein the trays include one or more shelves or support surfaces which are vertically oriented with respect to one another and wherein the lowermost shelf or support surface includes an enlarged surface portion and a reduced surface portion which cooperate with mounting legs extending from the enlarged surface portion so as to enable the trays to be slideably engaged along the full length of the bed side rails with portions of the lowermost shelf being extendable beyond the headboard when the trays are positioned in close proximity to the headboard.

14 Claims, 2 Drawing Sheets

DETACHABLE TRAYS FOR WATER BEDS

BACKGROUND OF THE INVENTION

1. Field of the Invention

This invention is generally directed to trays which are selectively mounted on the side rails of beds and other articles of furniture and more specifically to detachable trays which may be slideably engageable with the side rails found on conventional water beds. The trays of the present invention may include a single or a plurality of vertically spaced support shelves which are mounted to the side rail of the bed frame in such a manner that the trays may be disposed at any point along the side rails including adjacent to the headboard associated with the bed frame. The lowermost shelf is integrally formed having portions thereof extendable outwardly of the side rail while other portions thereof are mounted in direct overlying relationship with respect to the side rails so that as the tray is moved toward the headboard of the bed frame, the cantilevered or outwardly extending portions of the lower shelf will be positioned outwardly with respect to the headboard and therefore spaced in close proximity thereto without interfering with the movement of the trays until such point as the cantilevered portions engage a wall which is positioned rearwardly of the headboard of the bed frame.

The trays are also provided with elongated mounting legs which are easily engageable with opposing portions of the bed frame so that the shelves may be attached and detached without use of mechanical fasteners and are attached in such a manner that the trays may be easily adjusted horizontally with respect to the bed rail but are retained in secure and non-pivoting relationship with respect thereto.

2. History of the Related Art

Heretofore, there have been many tray-like structures which have been designed to be attached and supported by bed rails and bed frames so as to provide a surface upon which various articles may be conveniently placed relative to a bed. Many of these trays have been specifically designed to facilitate user comfort in medical or hospital environments where a person convalescing is not capable of moving from the bed to obtain personal articles such as books, glasses, towels, writing paper and the like or wherein the trays provide a support for food, medicines or other liquids which are to be consumed by the patient in the bed.

In De Long U.S. Pat. No. 4,357,881, a hospital bed tray is disclosed which is directly attached to a side rail of a hospital bed. In the coventional hospital bed, the side rails are designed having two or more generally parallel and horizontally oriented safety rails which are interconnected at spaced locations by vertical supports. The DeLong hospital bed tray is designed to be supported with one end of the tray being in pivotable relationship with the upper safety rail with supports extending from the outermost portion of the tray downwardly and inwardly into engagement with the lower safety rail. With this structure, once the lower support brackets are secured in place about the lower safety rail, the brackets may be extended or collapsed as desired to elevate the tray with respect to the upper safety rail. Unfortunately, with this type of structure, the trays are not designed to be shifted horizontally or along the length of the safety rails of the bed. The support brackets engage the lower support rail in such a manner that they may not slide past the vertical supports which are provided between the upper and lower safety rails. In addition, the brackets are clamped to the safety rails to insure stability of the tray and therefore are not conveniently moved without having to make adjustment to the engagement of the brackets with the safety rails. Due to the specialized environment of a hospital bed, patients are not normally entering and leaving the bed when the safety rails are elevated. Therefore, it is generally not necessary to provide a table or tray which is selectively mounted to the safety rails and which can be slidingly moved along the safety rails to facilitate movement of a patient into and out of the bed.

Yet another example of prior art bedside table which is particularly adapted for use with hospital-type beds having safety rails is disclosed in Jenssen, Jr. U.S. Pat. No. 3,340,826. The structure of bed tray disclosed in Jenssen, Jr. is such that the tray surface may be supported over the uppermost safety rail so as to extend inwardly towards the patient in the bed. The tray includes a depending frame member which is engageable with the opposing surfaces of the safety rails so that the hooked upper end portion of the tray cannot be pulled from engagement with the uppermost safety rail. A latch is also provided to prevent movement of the tray relative to the safety rails and thereby maintain the tray in a fixed position when necessary. Although this structure does permit a selective sliding movement of the tray relative to the safety rails, the tray may not be moved beyond the point adjacent the headboard of the hospital bed as the tray support extends inwardly and would engage the headboard when the tray is moved in close proximity to the headboard. In addition, the tray is not designed for use with all types of bedside rails or safety rails as the upper mounting portion is designed to partially encircle the upper safety rail. Thus, if any vertical supports are provided between the safety rails, it would not be possible to slide the shelf past such supports. The tray is designed for use with safety rails having horizontally oriented bar-like members which are freely spaced in relationship to the remaining portions of the bedside rail or safety rails. A similar structure is disclosed in Staiger U.S. Pat. No. 3,037,214.

Other types of safety side rail mounted support trays for use with hospital-type beds include trays which are designed for a specific purpose or utility. In Herron et al., U.S. Pat. No. 4,504,992 a hospital bed telephone holder is disclosed which includes a small tray for supporting a conventional telephone in cradled relationship with respect to the mounting frame which is secured over the upper safety rail by a hooked end portion. The remaining portion of the telephone support includes a depending support portion which functions similarly to the depending leg portions of the aforementioned references to Jenssen, Jr. and Staiger. With the structure of Herron et al., as the upper U-shaped portion does not wrap around the upper safety rail, the bracket may be moved along the length of the rail until instruction is met adjacent the headboard of the bed. Other examples of medical or hospital bed trays for use in medical facilities are disclosed in U.S. Pat. No. 2,703,265 which discloses an elongated track which is attachable to a bedside rail and which supports a tray that is longitudinally adjustable with respect thereto and U.S. Pat. No. 3,955,788 which discloses a support for optical laboratory instruments having mounting clamps which permit selective longitudinal adjustment of the equipment relative to a support.

The use of bedside tables has not been limited to hospital environments or for medical purposes. In Brown et al., U.S. Pat. No. 3,033,627, an all-purpose tray or table is disclosed which may be clamped to a sideboard of a conventional bed frame. The table is mounted to the upper portion of a shaft which is rotatably carried in a vertical support which is secured to the bed frame by opposing bracket members. Unfortunately, with this type of structure, movement of the tray longitudinally of the bed frame would require that the mounting brackets be adjusted to release them from the sideboard of the bed. In addition, when the trays are positioned adjacent the headboard of a bed, the entire tray surface must be pivoted away from the bed so as to not interfere or engage with the headboard of the bed. This requires that a structure be provided for pivoting the tray which structure is not only costly but requires adjustment each time the tray is maneuvered to a position adjacent the headboard of the bed.

Other types of trays or attachments for beds are disclosed in U.S. Pat. Nos. 4,431,154 to Hamm, 4,203,175 to Heine and 3,629,881 to Hinshaw.

SUMMARY OF THE INVENTION

This invention is directed to detachable bedside tables or trays which are particularly designed to be cooperatively mounted to the side rails incorporated with many conventional water beds. The trays include one or more shelves or support surfaces which are arranged in a vertically spaced relationship when more than one shelf is provided The lowermost shelf includes a somewhat L-shaped body portion having a main section which is designed to be disposed in overlying relationship with respect to the bed rail and from which an integrally cantilevered portion extends generally parallel to but slightly outwardly of the bed rail The primary and cantilevered portion of the lowermost shelf or support surface are normally integrally formed with one another and are supported relative to the bed rail by inner and outer generally L-shaped leg members which are secured to and depend from the primary portion of the lower shelf. The outermost leg extends downwardly a vertical distance which is greater than the downward extension of the innermost leg so that the opposing foot portions of the legs are in spaced vertical relationship with respect to one another. The foot portions of the legs are designed to engage on opposite sides of the water bed frame with the inner leg being engageable just below the upper surface of the rail so as to thereby prevent the accidental rotational displacement of the tray from the bedside rail.

In some embodiments of the invention, it may be preferred to provide adjustable leveling guides on the foot portion of the outer leg member which guides may be mechanically lengthened or shortened so as to adjust the fit of the foot portion relative to the sideboard of the bed rail The engagement, however, should be loose enough to permit the support shelf to be moved along the entire length of the bed rail. Further, due to the cantilevered portion of the surface of the lowermost support shelf, the shelf may be moved towards the headboard without the cantilevered portion of the shelf coming into engagement with the headboard but bypassing the headboard and being positioned outwardly thereof so that the primary portion of the support surface is brought into proximate relationship with the headboard.

In some embodiments of the invention, a second shelf may be selectively secured to the bottom shelf and is positioned so as to be cantilevered outwardly of the bed rail so as to not interfere with the movement of the tray as it approaches the headboard of a bed. In other embodiments, the trays may be provided with upper shelves which are generally coextensive with the underlying lowermost shelf. In yet other embodiments, openings may be provided in the shelves to facilitate the retention of glassware on the support shelves.

It is a primary object of the present invention to provide detachable support trays for use with the bed rails of conventional water beds and which are designed to be freely movable along the length of the side rails without becoming dislodged or removed therefrom and which may be moved to a maximum extent toward the headboard of the bed so as to facilitate the movement of a person into and out of the bed while maintaining the tray in engagement with the side rail.

It is a further object of the present invention to provide a multi-purpose tray which is easily and selectively mounted to a side rail of a conventional water bed and which will provide a plurality of vertically oriented surfaces which are cantilevered outwardly from the bed rail and at least one support surface which is positioned in overlying relationship with the support rail to thereby provide adequate support for a plurality of articles relative to the bed.

It is also an object of the present invention to provide a detachable tray for use with conventional water beds wherein the water beds have a frame and a headboard on which the detachable trays may be removed or installed without the need to require permanent mountings or tools and wherein the trays may be selectively positioned at any point along the length of the side rails of the bed frame and yet be maintained securely supported on the rails.

Figure 1:
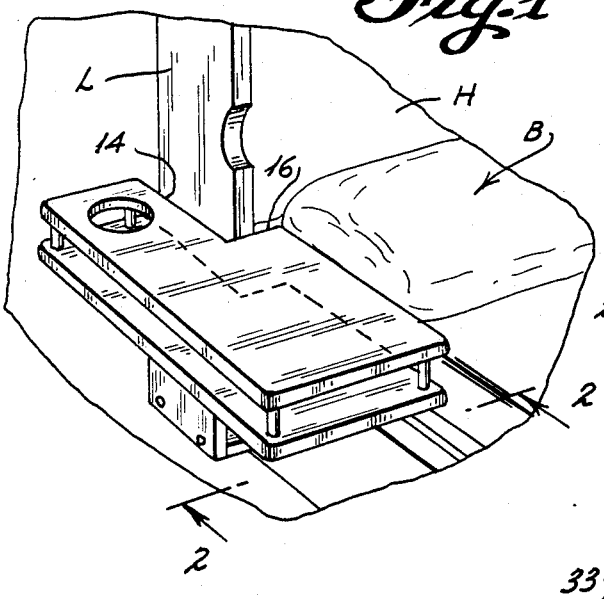
FIG. 1 an illustrational view showing one embodiment of the present invention as it is mounted to the side rail of a conventional water bed frame with the cantilevered portions of the tray being shown positioned outwardly adjacent the side of the headboard at which position the tray is in its closest proximity with respect to the headboard end of the bed.

FIG. a cross sectional view taken along lines 2–2 of FIG. 1 showing the embodiment of tray of FIG. 1 in end view as it is secured relative to the side rail of the bed frame of a water bed.

Figure 3:
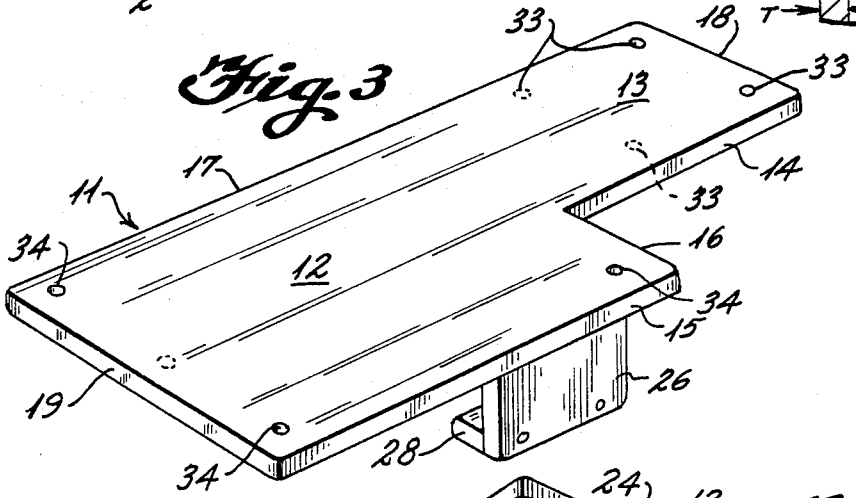

FIG. 3 is a perspective view of a single shelf embodiment of the present invention which includes mounting structure for incorporating additional vertically spaced shelves be selectively secured thereto.

Figure 4:
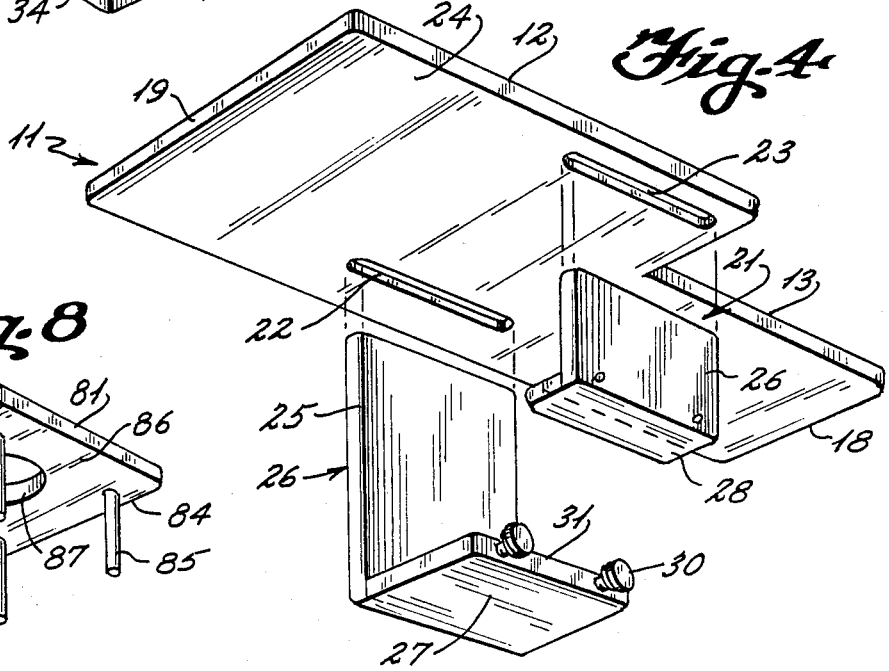

FIG. 4 is an assembly view of the embodiment of invention disclosed in FIG. 3 showing the mounting legs as they are positioned for respective installation with respect to the und of the shelf.

Figure 2:
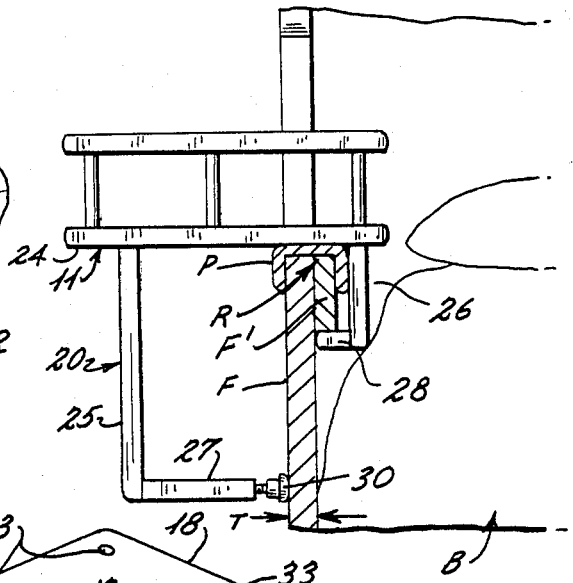
Figure 5:
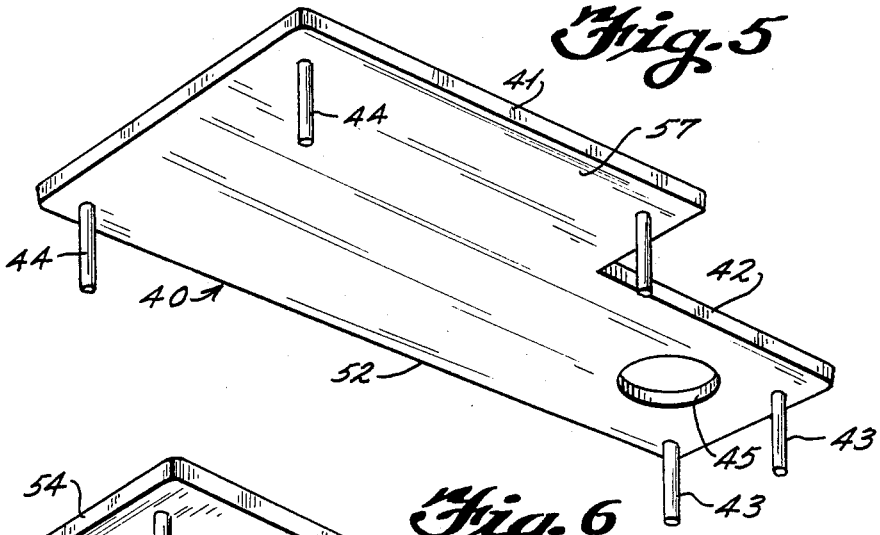

FIG. 5 is a perspective view taken from the underside of the upper support tray of the embodiment of invention shown in FIGS. 1 and 2.

Figure 6:
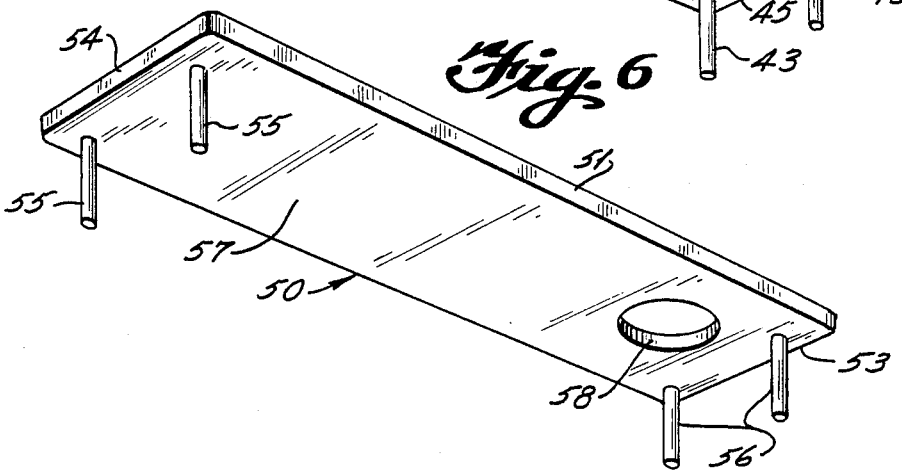

FIG. 6 is a perspective view taken from the underside of another embodiment of upper support tray which may be utilized primary support tray shown in FIG. 3.

Figure 7:
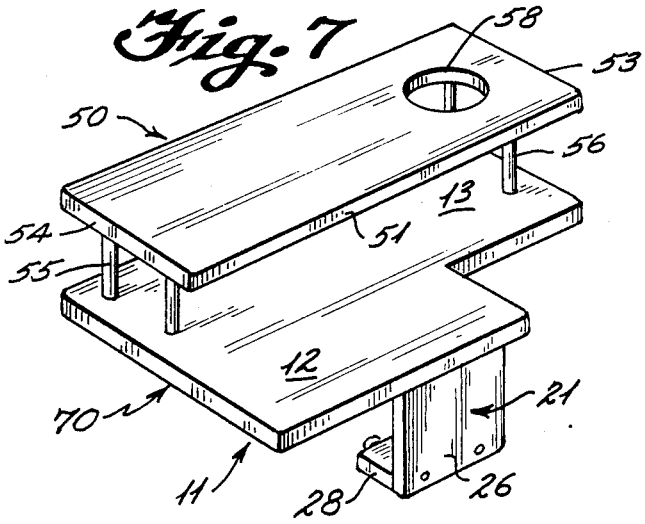

FIG. 7 is a perspective view of an embodiment of the invention incorporating the upper shelf shown in FIG. 6 with the lower shown in FIG. 3.

Figure 8:
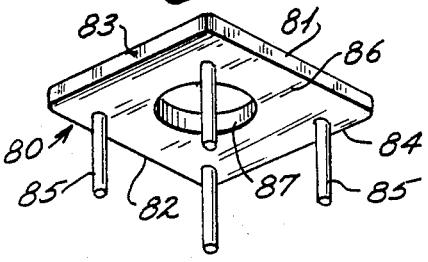

FIG. 8 is a perspective view taken from the underside of another embodiment of upper support shelf having a glassware su aperture provided therein.

Figure 9:
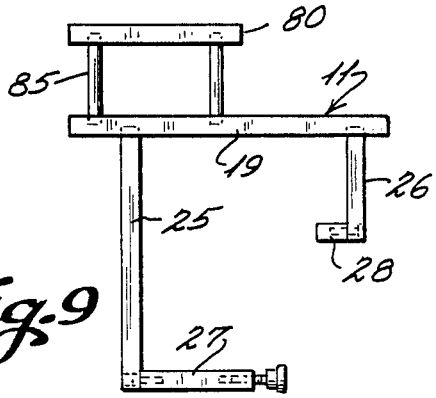

FIG. 9 end view of the support shelf of FIG. 8 incorporated and installed along the cantilevered end of the primary support shelf of FIG. 3.

DESCRIPTION OF THE PREFERRED EMBODIMENT

With continued reference to the drawings, the several embodiments of detachable bedside trays made in accordance with the teachings of the present invention will be disclosed as they are mounted to the side rail R associated with the bed frame F of a conventional water bed B. The trays are selectively adjustable along the length of the side rail R with portions of the trays extending outwardly adjacent the flange L of the headboard H of the water bed. As shown in FIG. 2 of the drawings, the side rail is generally defined by the uppermost portion of the bed frame F which may or may not be covered by padding P so as to provide a soft surface along the length of the bed rail.

The most basic form of the present invention is embodied in a single detachable shelf 10 such as disclosed in FIGS. 3 and 4. The shelf 10 includes a generally L-shaped primary support surface 11 having rectangular section 12 and a cantilevered section 13 which are integrally formed with respect to one another. The innermost edge 14 of the section 13 is shown as being spaced outwardly with respect to the innermost edge15 of the section 12 with such edges being connected by an intermediate outwardly extending wall portion 16. The outermost edge 17 of the support surface is shown as being generally continuous between the sections 12 and 13. Surface 11 is further defined by a reduced end portion 18 and an enlarged end portion 19 associated with the cantilevered and the main sectons 13 and 12, respectively.

The support shelf 10 further includes a pair of mounting brackets 20 and 21 which may be selectively received and seated within elongated slots 22 and 23 provided in the undersurface 24 of the support surface section 12 or may be otherwise secured in fixed relationship with respect to the undersurface 24 of section 12. Each of the mounting brackets includes a vertically depending leg member 25 and 26 which are of different length. As shown, the leg 25 of bracket member 20 is longer than that of leg 26 of bracket member 21. A pair of inwardly extending flanges or foot elements 27 and 28 are mounted or otherwise secured to the lowermost ends of the legs 25 and 26 and are mounted so as to extend inwardly toward one another. It should be noted, and as shown in FIG. 2, that the outermost portions of each of the foot members 27 and 28 are horizontally spaced apart by a distance which is just greater than the thickness T of the frame for the water bed so that the frame may be selectively received between each of the outermost end portions of the feet 27 and 28 when the shelf is mounted to the rail R of a water bed as shown in FIG. 2. To provide some latitude for adjustment of the support legs relative to the water bed frame, a pair of adjustable leveling guides 30 may be threadingly engaged to the end portion 31 of the foot member 27 so as to be movable inwardly and outwardly with respect thereto. In this manner, the gap defined between the outermost end portions of the foot members 27 and 28 may be adjusted so as to both stabilize and level the shelf 10 when the shelf is mounted in overlying engagement with the rail of the water bed. The guides 30 should be adjusted to such an extent that the shelf may be slideably repositioned along the length of the rail to thereby permit the shelf to be moved from one end of the bed rail to another depending on the positioning necessary to facilitate the use of the shelf by an individual in the bed or by an individual getting into or leaving the bed.

With specific reference to FIGS. 1 and 2, the detachable trays of the present invention are mounted to the frame and side rail of the bed in such a manner that the foot portion 28 of bracket member 21 is vertically spaced below the upper surface of the side rail and in abutting relationship thereto. In this position, the lower surface 24 of the support shelf 11 will be in seated engagement with the padding P, if provided over the bed rail, with stability being provided bythe outer bracket member 20 which is selectively and adjustably engageable with the frame at a point vertically spaced below the foot member 28. With the structure shown, once the tray is attached in mounted relationship overlying the side rail R, the shelf may be moved along the length of the support rail. Further, the notch that is provided in the support surface as defined by edges 14 and 16 of the shelf element 11 will allow the cantilevered portion 13 of the shelf to be extended outwardly beyond the extension portion L of the headboard H as shown in FIG. 1 as the tray is moved towards the headboard. Therefore, the tray may be moved to a maximum extent adjacent the headboard until such time as the leading edge 18 of the support surface 11 engages a wall or other element beyond the headboard or until such time as edge 16 of the support surface engages the outward extending portion L of the headboard H. In this position, the tray is generally in such a remote location that a person may enter and leave the bed without interference from the tray.

In order to provide a detachable bedside tray which has greater support capability and therefore greater utility, the basic support shelf 11 may be utilized in combination with additional vertically spaced shelving members as will be discussed hereinafter. To facilitate the assembly of additional vertical shelves with the basic shelf 10, the basic shelf in some embodiments may be provided with a plurality of spaced holes or openings 33 and 34 in which vertical supports associated with the additional shelves are selectively received . A first form of supplemental shelf 0 is disclosed and shown in detail in FIG. 5 and FIG. 1. In this embodiment, supplemental shelf 40 includes a large section 41 and smaller section 42, each of which is coextensive and vertically spaced from the corresponding support surfaces or sections 12 and 13 of the underlying primary support shelf 11. In this respect, each of the primary support shelves 11 and the vertically spaced supplemental shelves 40 are of identical outer configuration so that the shelves may be maneuvered along the entire length of the rail R of the bed frame. The supplemental shelf 40 includes a plurality of vertically depending mounting supports 43 and 44 which are selectively engageable with the openings 33 and 34 in the lower support shelf. As shown, only two support rods 43 are utilized and are seated in the outermost openings 33 adjacent the leading edge 18 of the shelf 11. An opening 45 may be provided through the smaller portion 42 of the supplemental support shelf for purposes of receiving a glass or other container therein. The opening will therefore serve to stabilize any container which may be placed on the tray and prevent the container or glass from being accidentally dislodged or tipped in the event the tray is shifted along the length of the support rail.

A second embodiment of upper support shelf is shown in FIG. 6. The second supplemental support shelf 50 is generally rectangular in configuration and is generally of a width which is equal to the width of the section 13 of the primary support shelf 11 as taken between the inner edge 14 and the outer edge 17 thereof. Supplemental support shelf 0 includes generally parallel front and rear edges 51 and 52 and end edges 53 and 54 which as previously discussed are generally coextensive with the ends 18 and 19 of the underlying support shelf 12. Four mounting rods 55 and 56 are secured to the undersurface 57 of the support shelf 50. The support rods 56 are engageable with the outermost openings 33 of the underlying shelf 11 with the support rods 5 being engageable with the two openings 34 disposed closest to the edge 17 of the lower primary support shelf. As with the prior embodiment, an opening such as shown at 58 may be provided for selectively supporting glassware or other articles securely therein so that such articles are not accidentally tipped when the tray is moved along the length of the bedside rail. When assembled, the embodiment of supplemental support shelf 50 shown in FIG. 6 will work in combination with the lower support shelf to form a bedside tray as shown at 70 in FIGS. 1, 2 and 7.

Another embodiment of supplemental shelf of the present invention is disclosed in FIGS. 8 and 9 of the drawings. In this embodiment, the supplemental support 80 is shown as having opposing ends 81 and 82 and side wall edges 83 and 4. The side edges 83 and 84 are spaced apart a distance which makes them generally vertically spaced and coextensive with the edges 14 and 17 associated with the underlying support shelf 11. In addition, the end 81 of the supplemental shelf is generally coextensive with the underlying end 18 of the support shelf 11. A plurality of mounting rods 85 depend from the lower surface 86 of the supplemental support shelf and are selectively engageable within the openings 33 in the cantilevered section 13 of the lower support shelf 11. As with the prior embodiments, the supplemental support shelf may include an opening 87 which forms a receiving aperture for a glass, bottle or other container so that the glass, bottle or other container will be stabilized and retained positively with respect to the bedside tray even when the tray is moved along the length of the bed rail.

Although the various embodiments of the present invention have been discussed as being selectively assemblable, it is ossible that each of the separate embodiments may be manufactured and sold as completed articles of furniture.

It is preferred that the detachable support trays of the present invention are constructed of wood having a fine finish, however, in some instances, the trays may be molded of a suitable plastic material with the components thereof being selectively interfitted.

We claim:

1. A detachable bedside tray for use with water beds having a bed frame which includes a side rail which extends along the length of the water bed and which is defined by a given width dimension, the tray comprising a primary shelf means, said primary shelf means having upper and lower surfaces, first and second sections, and two end portions, each of said first and second sections of said primary shelf means having inner and outer edges, said outer edges being in continuous alignment, said inner edge of said second section being offset with respect to said inner edge of said first section so as to be spaced in closer proximity to said outer edges, said inner edges connected by an edge wall perpendicular to said inner edges, bracket means depending from said lower surface of said first section of said primary shelf means, said bracket means including first and second leg members which are oriented in generally opposing relationship with respect to one another and which are spaced apart a distance which is substantially equal to or greater than the width of a side rail of a water bed frame, said first leg being positioned adjacnet said inner edge of said first section whereby said primary shelf means may be selectively supported on a side rail of a water bed frame so that said first section thereof is in overlying relationship with respect to the side rail with said first and second leg members of the bracket means extending adjacent to the side rail and on opposite sides thereof.

2. The detachable bedside tray of claim 1 in which each of said first and second leg members includes upper and lowermost end portions, said upper end portions being connected to said lower suface of said primary shelf means and said lowermost end portions extending downwardly with respect thereto, said lowermost end portion of said second leg member extending downwardly a distance greater than the lowermost end portion of said first leg member, and abutment means secured to the lowermost end portions of each of said first and second leg members, said abutment means extending generally perpendicularly with respect to said first and second leg members and in generally horizontal relationship with respect to said primary shelf means, said abutment means being spaced apart relative to one another a distance which is equal to or greater than the width of a side rail of a water bed frame.

3. The detachable bedside tray of claim 2 including at least one adjustable leveling guide means mounted to one of said abutment means, said adjustable leveling guide means being selectively extendable outwardly with respect to said one of said abutment means so as to vary the spacing between said leveling guide means and the other of said abutment means.

4. The detachable bedside tray of claim 2 including a second shelf means having upper and lower surface portions, means for mounting said second shelf means in vertically spaced relationship above said primary shelf means, said second shelf means being coextensive with said primary shelf means.

5. The detachable bedside tray of claim 4 including an opening formed in said second shelf means whereby articles may be selectively received within said opening.

6. The detachable bedside tray of claim 4 in which said means for mounting said second shelf means with respect to said primary shelf means includes a plurality of post means, each of said post means having upper and lower end portions, said upper end portions of said post means being secured to said lower surface of said second shelf means and said lower end portions of said post means being secured to said upper surface of said lower shelf means, said post means being positioned both along said first and second sections of said primary shelf means.

7. The detachable bedside tray of claim 2 including a second shelf means, means for mounting said second shelf means in vertically spaced relationship above said primary shelf means, said second shelf means being generally rectilinear in configuration and having opposite end portions, at least one of said end portions being coextensive with said second section of said primary shelf means, the other one of said end portions being within an area defined by said inner and outer edges and end portion of said first section.

8. The detachable bedside tray of claim 7 including an opening through said second shelf means, said opening being of generally circular configuration.

9. The detachable bedside tray of claim 7 wherein said second shelf means is generally square in configuration, said means for mounting said shelf means including a plurality of post means extending from said upper surface of said second settion of said primary shelf means to said second shelf means.

10. A combination slideably adjustable bedside tray and water bed comprising a water bed having a bed frame defined by side rails and a headboard mounted adjacent one end of said the side rails and wherein the side rails are defined by a given width dimension, a tray having a primary shelf means having generally planar upper and lower surfaces and inner and outer edges, and end portions, said primary shelf means having a generally L-shaped configuration defining a notch formed in one portion thereof, said notch being oriented toward said headboard when said tray is mounted thereto, said inner edges of said primary shelf means including first and second offset edge portions, said primary shelf means having a first enlarged section and second reduced section which are coplanar with respect to one another, a bracket member depending from said first section of said primary shelf means, said bracket member including a pair of generally L-shaped leg members having inwardly extending and opposing lower ends, said lower end of one of said leg members being vertically spaced with respect to said lower end of the other of said leg members, said lower ends of said leg members being spaced by a distance which is at least equal to the width dimension of said side rail of said bed frame, one of said side rails of said be frame selectively received between said lower ends of said leg members with said first section of said primary shelf means being in overlying relationship with respect to said one of said side rails with said second section of said primary shelf means being cantilevered outwardly in generally parallel relationship with respect to said one of said side rails so that said tray may be selectively supported and shifted along said one of said side rails without said second section of said primary shelf means engaging said headboard of said bed frame.

11. The combination slideably adjustable bedside tray and water bed of claim 10 including at least one second shelf means, means for mounting said second shelf means in vertically spaced relationship with respect to said primary shelf means, said second shelf means being of a configuration so as not to overly the notch formed in said primary shelf means.

12. The combination slideably adjustable bedside tray and water bed of claim 10 including a plurality of spaced openings in said first and second sections of said primary shelf means, post means having a first end which is selectively received within said spaced openings in said primary shelf means and second ends which extend in vertically elevated relationship with respect to said primary shelf means, a second shelf m®ans having upper and lower surface portions, said second shelf means having a plurality of openings formed in said lower surface thereof, said second ends of said post means being selectively receivable within said openings in said lower surface of said second shelf means whereby said second shelf means may be selectively mounted with respect to said primary shelf means.

13. The combination slideably adjustable bedside tray and water bed of claim 12 in which said second shelf means is of a configuration so as to be coextensive with respect to said first and second sections of said primary shelf means.

14. The oombination slideably adjustable bedside tray and water bed of claim 10 in which said second shelf means is generally rectangular in configuration having first and second end portions, said first end of said second shelf means extending over and coextensive with said second section of said primary shelf means and said second end portion of said second shelf means extending over and within an area defined by said inner and outer edges and end portion of said first section of said primary shelf means.

* * * * *